US006339888B1

(12) United States Patent
Brunson et al.

(10) Patent No.: US 6,339,888 B1
(45) Date of Patent: Jan. 22, 2002

(54) DISPOSABLE SHOE COVER

(75) Inventors: Kevin K. Brunson, Argyle; Marc E. Pinney, Grapevine; Barbara A. McCarty, Halton City; Frank D. Rasberry, Bedford; Sheldon T. Fields, Fort Worth, all of TX (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/503,643

(22) Filed: Feb. 14, 2000

Related U.S. Application Data

(63) Continuation of application No. 09/069,299, filed on Apr. 29, 1998, now Pat. No. 6,023,856, which is a continuation-in-part of application No. 08/686,348, filed on Jul. 25, 1996, now abandoned.

(51) Int. Cl.[7] ..... A43B 3/16; A43B 1/02; A43D 11/00

(52) U.S. Cl. ..... 36/7.1 R; 12/142 G; 36/9 R

(58) Field of Search ..... 12/142 G; 36/7.1 R, 36/9 R, 9 A, 11, 45

(56) References Cited

U.S. PATENT DOCUMENTS

| | | | | |
|---|---|---|---|---|
| 203,851 | A | 5/1878 | Pitts | |
| 1,104,357 | A | 7/1914 | Hassel | |
| 1,817,623 | A | 8/1931 | Hervey | |
| 2,177,321 | A | * 10/1939 | Iwan | 12/142 G |
| 2,305,926 | A | 12/1942 | Kohler | |
| 2,679,117 | A | * 5/1954 | Reed | 12/142 G |
| 3,000,118 | A | 9/1961 | O'Shea | |
| 3,058,241 | A | 10/1962 | Rigsby | |
| 3,084,459 | A | 4/1963 | Colman | |
| 3,283,422 | A | 11/1966 | Nygard | |
| 3,308,562 | A | 3/1967 | Zimmon | |
| 3,335,506 | A | 8/1967 | Pence | |
| 3,358,188 | A | 12/1967 | Zimmon | |
| 3,402,323 | A | 9/1968 | Longstreth | |
| 3,422,550 | A | 1/1969 | Robinson | |
| 3,442,034 | A | 5/1969 | Moore et al. | |
| 3,605,291 | A | 9/1971 | Moore et al. | |
| 3,634,954 | A | 1/1972 | Larson et al. | |
| 3,684,922 | A | 8/1972 | Ericson | |
| 3,737,723 | A | 6/1973 | Kanor | |
| 3,824,714 | A | 7/1974 | Glassman | |
| 3,898,750 | A | 8/1975 | Epstein | |
| 4,019,265 | A | 4/1977 | Epstein | |
| 4,023,281 | A | 5/1977 | Terry | |
| 4,083,124 | A | 4/1978 | Michalak | |
| 4,272,859 | A | 6/1981 | Vanhove | |
| 4,304,021 | A | 12/1981 | Theodorsen | |
| 4,598,485 | A | 7/1986 | Jose et al. | |

(List continued on next page.)

FOREIGN PATENT DOCUMENTS

| | | |
|---|---|---|
| DE | 803023 | 7/1949 |
| FR | 2532337 | 3/1984 |
| FR | 2575044 | 6/1986 |
| FR | 2619998 | 3/1989 |
| FR | 2527907 | 6/1993 |
| GB | 2124472 | 2/1984 |

*Primary Examiner*—M. D. Patterson
(74) *Attorney, Agent, or Firm*—Dority & Manning, P.A.

(57) ABSTRACT

A disposable shoe cover is provided for use with a wide range of foot sizes and different types of shoes and/or boots. A disposable shoe cover can be fabricated from a wide variety of different materials to enhance the performance of the resulting shoe cover. A disposable shoe cover is formed from three separate panels of material seamed together or from a single continuous web of material segmented into three panels by elastomeric bands. In one embodiment, the shoe cover may also include an angled seam section along the back heel portion to prevent bunching of the sole portion at or under the sole of the shoe.

4 Claims, 9 Drawing Sheets

U.S. PATENT DOCUMENTS 4,610,042 A 9/1986 Theodorsen
4,616,428 A 10/1986 Leger
4,616,429 A 10/1986 Alacala
4,665,633 A 5/1987 Edgerton
4,847,934 A 7/1989 Weber
4,918,839 A 4/1990 Brandon
4,937,881 A 7/1990 Heise
4,967,491 A 11/1990 Plotkin
5,059,277 A 10/1991 Willhite, Jr. et al.
5,062,223 A 11/1991 Johnson
5,114,509 A 5/1992 Johnston et al.
5,165,182 A 11/1992 Michael
5,362,306 A 11/1994 McCarver et al.
5,383,988 A 1/1995 Herrmann et al.
5,394,624 A 3/1995 Siepser
5,409,761 A 4/1995 Langley
5,486,166 A 1/1996 Bishop et al.
5,490,846 A 2/1996 Ellis et al.
5,492,591 A 2/1996 Herrmann et al.
5,822,884 A 10/1998 Roeder
6,023,856 A * 2/2000 Brunson et al. ..... 36/7.1 R

* cited by examiner

FIG. 4
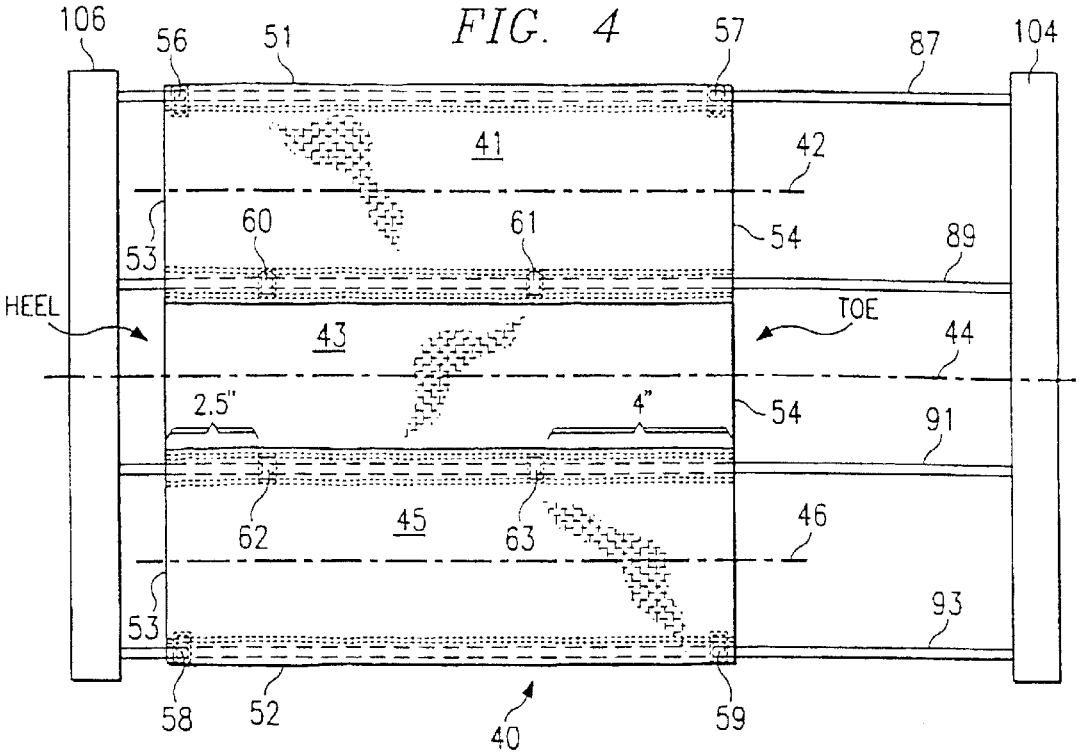
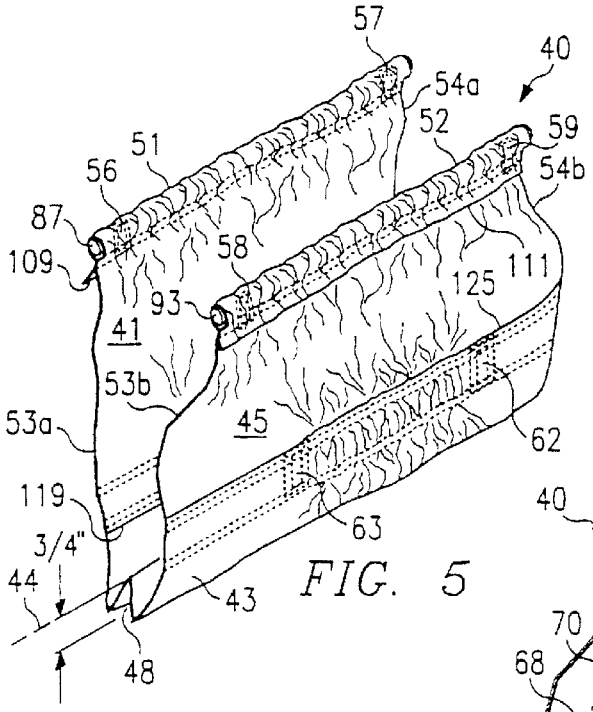
FIG. 5
FIG. 6
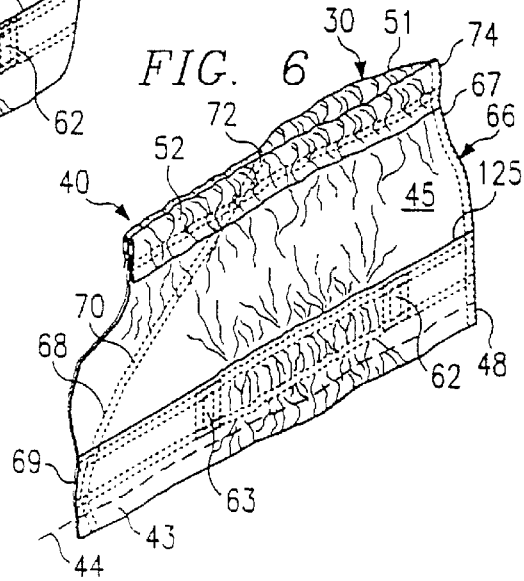

DISPOSABLE SHOE COVER

The present application is a Continuation application of Ser. No. 09/069,299 filed on Apr. 29, 1998, now U.S. Pat. No. 6,023,856.

This application is a Continuation-in-Part (CIP) application of U.S. patent application Ser. No. 08/686,348, filed Jul. 25, 1996 now abandoned.

This invention is related in general to disposable protective clothing and in particular to disposable shoe covers.

TECHNICAL FIELD OF THE INVENTION

Background of the Invention

Sterile reusable clothing has previously been used in many health care environments. Due to the inconvenience and cost of cleaning and providing sterile storage for such clothing, a switch to disposable products has generally occurred. For example, the demand for disposable shoe covers has increased substantially during the past several years and is now standard practice for most surgical procedures. Health care workers in emergency rooms and other medical environments wear disposable shoe covers to protect the health care environment from microbial and other types of contamination carried by shoes and to protect the respective health care worker from contamination by blood and other body fluids.

In addition to the health care industry, it is necessary in many other industries to wear protective clothing to prevent contamination of clean room type working environments. In certain environments it is also necessary to prevent stray electricity such as static electricity and sparks, from damaging sensitive electronic circuits or accidentally igniting a possibly volatile atmosphere.

Disposable shoe covers are worn in a wide variety of industrial environments for many reasons such as providing either a conductive or non-conductive electrical surface depending upon the environment preventing contamination of both the wearer and the surrounding environment, and providing a non-skid walking surface for the wearer. Disposable shoe covers have often been manufactured from a single type of material. Since it is difficult to find a single material with all the desired characteristics such as, fluid resistance, breathability, non-skid surface, anti-static and durability, some desired characteristics have frequently been enhanced to the detriment of other desired characteristics.

SUMMARY OF THE INVENTION

In accordance with the present invention, a disposable shoe cover is provided to substantially reduce or eliminate shortcomings previously associated with prior disposable shoe covers. A disposable shoe cover incorporating teachings of the present invention provides an effective barrier to protect the surrounding environment from any contamination carried by the wearer's shoes and at the same time assists with protecting the wearer for the surrounding environment. A disposable shoe cover may be formed from material selected in accordance with the teachings of the present invention to protect the wearer's shoes and feet from contamination by potentially dangerous fluids, liquids, aerosols and/or other sources of contamination in the surrounding environment. A disposable shoe cover may be formed from material selected in accordance with the teachings of the present invention to provide a non-skid surface for walking and/or a static free, electrically conductive surface. A relatively low cost disposable shoe cover may be formed in accordance with the teachings of the present invention from different types of material to provide all or selected portions of the previously noted features.

One aspect of the present invention includes providing a disposable shoe cover formed from a generally quadrilateral sheet of material or blank having three panels. Four resilient or elastomeric bands or strips are disposed on and attached to the quadrilateral sheet of material approximately parallel with and spaced laterally from each other. Two of the elastomeric bands are respectively disposed adjacent to opposite edges of the quadrilateral sheet. The other two elastomeric bands are respectively spaced between the center line of the quadrilateral sheet and one of the elastomeric bands or straps on opposite edges of the quadrilateral sheet.

For one application, the quadrilateral sheet of material may be folded along its longitudinal center line. Adjacent lateral edges extending from the resulting fold are preferably sealed to each other to form the disposable shoe cover. For one application a W-shaped fold is preferably formed in the middle panel of the quadrilateral sheet extending along the center line. The W-shaped fold cooperates with sealing the adjacent lateral edges to provide a better fit between the disposable shoe cover and the wearer's shoe. For still other applications, the quadrilateral sheet may be folded parallel with respect to the middle elastomeric bands to provide a generally T-shaped configuration at each lateral edge of the quadrilateral sheet. The resulting T-shaped configuration at each end of the quadrilateral sheet is preferably sealed to form opposite ends of the resulting disposal shoe cover.

Technical advantages of the present invention include high speed manufacture of a relatively low cost disposal shoe cover satisfactory for use with a wide range of shoe types and sizes. The present invention allows selecting appropriate material depending upon the intended working environment to enhance the performance of the resulting disposable shoe cover. For example, materials having high fluid resistance, good breathability, nonskid surface, static free and/or improved wearability may be used as desired to fabricate selected portions of the resulting disposable shoe cover. The present invention allows the use of two or more different types of material without substantially increasing manufacturing costs of the disposable shoe cover other than raw material costs associated with each type of selected material.

In accordance with another aspect of the present invention, a disposable show cover may be fabricated from a quadrilateral sheet of material or blank which has been formed from three or more continuous strips or webs of material. For some applications, the three continuous strips may be the same material. For other applications, each continuous strip may be a different type of material to enhance the performance of the resulting disposable shoe cover depending upon the intended working environment. Four bands or straps of elastomeric material are respectfully disposed along each longitudinal edge of the blank and adjacent to each longitudinal junction or seam between the three continuous strips of material.

Further technical advantages of the present invention include providing a disposable shoe cover that does not have a seam on the bottom of the shoe cover in contact with the sole of a wearer's shoe. Particulate contamination is substantially reduced or eliminated by not placing a seam in contact with the sole of a wearer's shoe. The present invention also results in placing two bands of elastomeric material extending longitudinally along opposite sides of the wearer's shoe adjacent to the sole. These two elastomeric bands result in shaping a generally rectangular panel in the middle of the blank into a generally oval configuration corresponding approximately with the sole of the wearer's shoe.

BRIEF DESCRIPTION OF THE DRAWINGS

For a more complete understanding of the present invention, and the advantages thereof, reference is now made to the following written description taken in conjunction with the accompanying drawings, in which like reference numbers indicate like features, and wherein:

FIG. 4 is a schematic drawing showing a plan view of the blank of FIG. 3 after additional bonded areas have been formed on the elastomeric bands;

FIG. 5 is a schematic drawing showing an isometric view of the blank of FIG. 4 folded in accordance with one embodiment of the present invention;

FIG. 6 is a schematic drawing showing an isometric view of another step in the process of fabricating a disposable shoe cover from the blank of FIG. 4;

DETAILED DESCRIPTION OF THE INVENTION

The preferred embodiments of the present invention and its advantages are best understood by referring to FIGS. 1 through 14 of the drawings, like numerals being used for like and corresponding parts of the various drawings.

Figure 1:
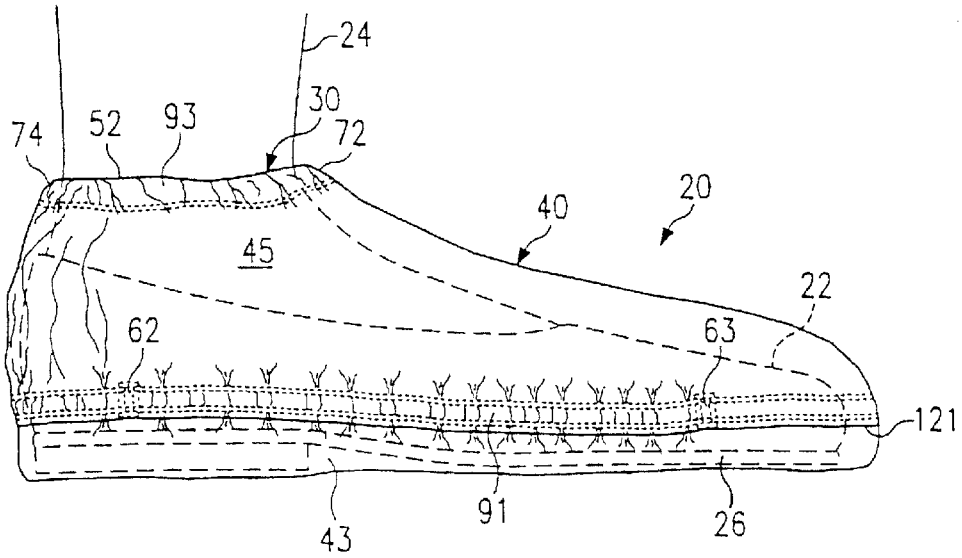
FIG. 1 is a schematic drawing showing a perspective view of a disposable shoe cover incorporating teachings of the present invention on a wearer's foot.

Disposable shoe cover 20 incorporating various teachings of the present invention is shown in FIG. 1 covering shoe 22 on the foot of wearer 24. As a result of the present invention, disposable shoe cover 20 may be adapted to slip over various types and sizes of shoes and is not limited for use with only shoe 22 shown in FIG. 1. The present invention may be used to provide disposable covers for boots (not shown) and other types of footwear in addition to shoes. The term "shoe" as used in this application is intended to include all types of shoes, boots, sandals and other types of footwear.

A disposable shoe cover may be formed in accordance with teachings of the present invention from a sheet or blank having at least three panels of selected material and four bands or straps of elastomeric material. The terms "band" and "strap" are used in this application to mean a length of material substantially longer than it is wide. The elastomeric bands or straps have a reduced width as compared to the width of the associated panels.

Disposable shoe cover 20 is preferably formed from sheet or blank 40 having three panels 41, 43 and 45. Panel 43 or the middle panel of blank 40 is generally disposed under sole 26 of shoe 22. Panels 41 and 45 are disposed adjacent to and extend over the sides of shoe 22 when disposable shoe cover 20 is placed on the foot of wearer 24. Panel 41 is not shown in FIG. 1.

For some applications, a disposable shoe cover may be formed in accordance with the teachings of the present invention with more than three panels and four elastomeric bands. However, one of the panels, such as middle panel 43, is preferably disposed under sole 26 without any seams in direct contact with the bottom of sole 26. This feature of the present invention substantially reduces particulate contamination from the resulting disposable shoe cover 20.

Blank 40 is preferably folded, bonded and cut in accordance with teachings of the present invention to allow elastomeric bands 87,89, 91 and 93 to conform disposable shoe cover 20 with various types and sizes of shoes. Disposable shoe cover 20 includes opening 30 defined in part by elastomeric bands 87 and 93 which hold disposable shoe cover 20 on the foot of wearer 24. Elastomeric bands 89 and 91 are preferably disposed adjacent to and extend longitudinally along opposite sides of sole 26 of shoe 22. Elastomeric band 89 and 91 cooperate with each other to allow disposable shoe cover 20 to be adopted to a wide variety of shoe sizes and types. Elastomeric bands 87 and 89 are not shown in FIG. 1.

Figure 2:
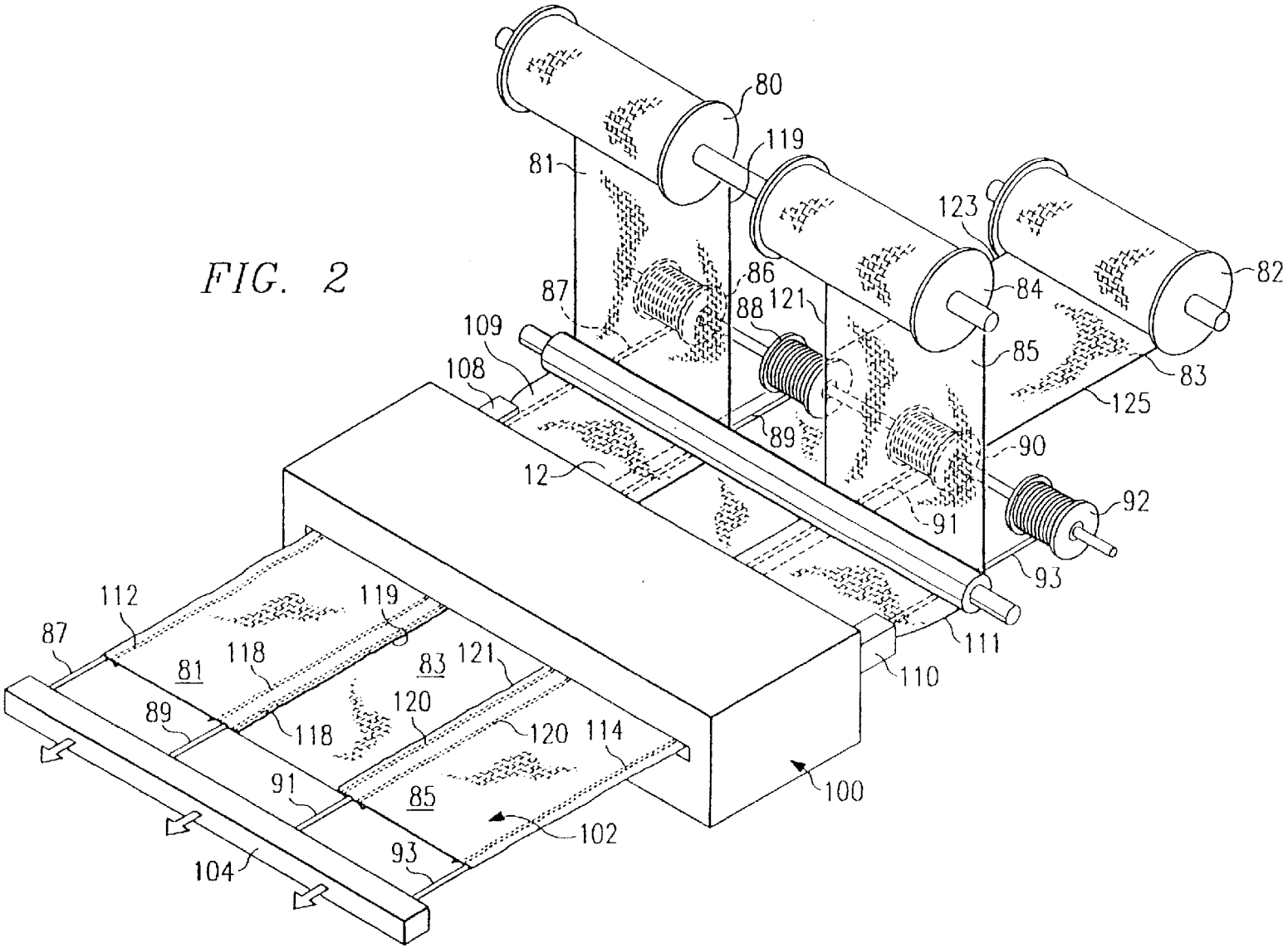
FIG. 2 is a schematic drawing showing an isometric view with portions broken away of equipment used to form an intermediate piece of material for fabrication of disposable show covers in accordance with the teachings of the present invention from three continuous strips or webs of material and four bands or strips of elastomeric material.

FIG. 2 shows a schematic representation of an apparatus and method which may be satisfactorily used to form disposable shoe cover 20 from three continuous strips or webs of material 81, 83 and 85 and four continuous straps of elastomeric material 87, 89, and 91 and 93. Continuous webs 81, 83 and 85 are provided from respective rolls 80, 82 and 84 of selected raw material having the desired characteristics for disposable shoe cover 20. One of the technical benefits of the present invention includes the ability to vary the type of raw material selected to provide each continuous web 81, 83 and 85 depending upon the environment in which disposable shoe cover 20 will be worn. Appropriate materials may be selected without substantially increasing the cost of fabricating the resulting disposable shoe cover 20 except for any change in raw material costs.

A wide variety of rollers, motors, tensioners, guides and control systems are available to allow quickly replacing rolls 80, 82 and 84 such that strips 81, 83 and 85 are essentially continuous webs of the selected raw material. In a similar manner, rolls 86, 88, 90 and 92 may be replaced to provide respectively continuous elastomeric strips 87, 89, 91 and 93.

U.S. Pat No. 3,684,922 entitled "Anti-Static Plastic Shoe Cover and Method of Making Same"; U.S. Pat. No. 4,304,021 entitled "Method and Apparatus for Making Disposable Shoe Covers"; and U.S. Pat. No. 4,616,429 entitled "Disposable Shoe Cover" show representative examples of various types of rollers, feed motors, tensioners, guides, and control systems that may be satisfactorily used with the present invention. Each of these patents is incorporated by reference for all purposes within this application.

Bonding apparatus 100 is provided to attach continuous webs 81, 83 and 85 with each other along with elastomeric straps 87, 89, 91 and 93 to form intermediate piece 102. Intermediate piece 102 may also be described a continuous web of material having a width equal to approximately the combined total width of continuous webs 81, 83 and 85 less any overlap between adjacent portions of continuous webs 81, 83 and 85.

For purposes of illustration, elastomeric straps 87, 89, 91 and 93 are shown attached to tensioner 104 extending from bonding apparatus 100. In actual practice, tensioner 104 may include a series of tensioners, takeup rollers, clamps and buffers as appropriate for handling a continuous web of material such as intermediate piece 102 and blanks 40 which are formed therefrom.

Depending upon the specific type of material associated with continuous webs 81, 83, and 85 and elastomeric straps 87, 89, 91 and 93, bonding apparatus 100 may include sewing machines, hot melt adhesive applicators, radio frequency (RF) bonding equipment, ultrasonic bonding equipment, heat and pressure bonding equipment, impulse sealing equipment or any other type of equipment that can be used to attach continuous webs 81, 83 and 85 with each other and elastomeric straps 87, 89, 91 and 93 in accordance with teachings of the present invention.

U.S. Pat. No. 5,059,277, entitled "Adhesive-Free Bonding of Continuously Moving Webs to Form Laminate Web"; U.S. Pat. No. 5,114,509, entitled "Starch Adhesive Bonding"; and U.S. Pat. No. 5,383,988, entitled "Modular Apparatus for Fabricating an Absorbent Article" show representative examples of various types of ultrasonic bonding equipment that may be satisfactorily used as part of bonding apparatus 100. These patents are incorporated by reference for al purposes within this application. The specific type of bonding apparatus may be varied depending upon the material selected for continuous webs 81, 83 and 85 and elastomeric straps 87, 89, 91 and 93.

Figure 3:
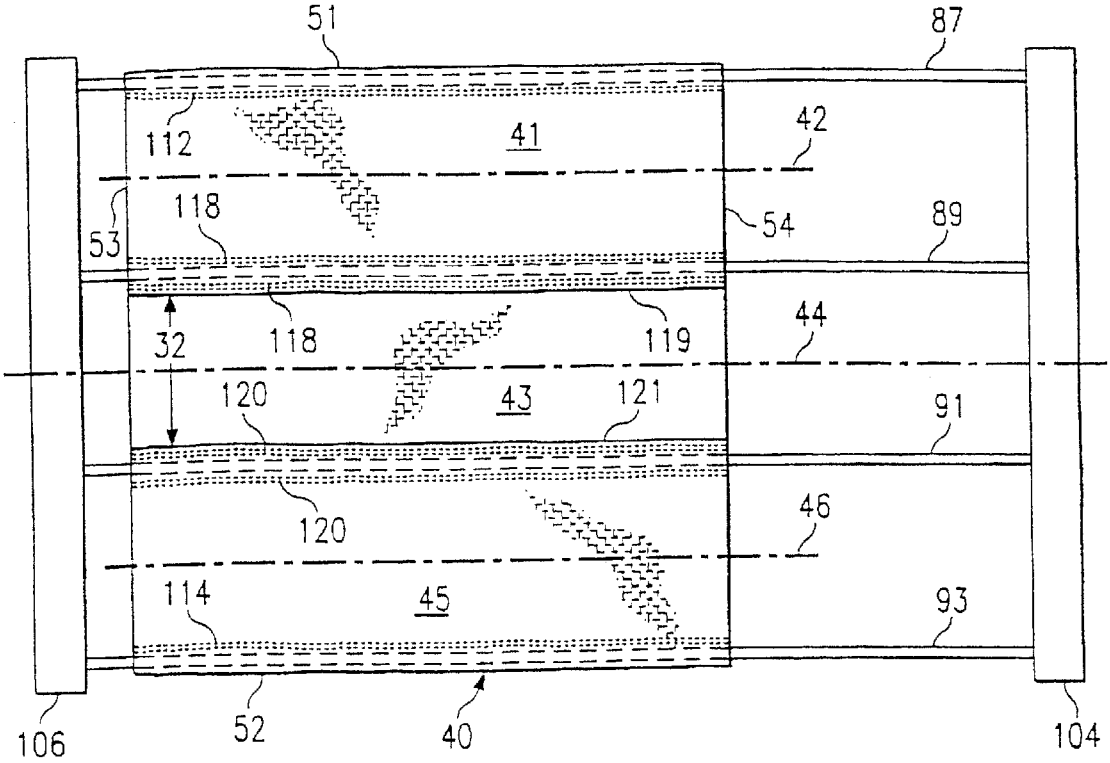
FIG. 3 is a schematic drawing showing a plan view of a quadrilateral sheet or blank having three panels which may be used to fabricate a disposable shoe cover in accordance with teachings of the present invention.

For the embodiment of the present invention as shown in FIG. 2, middle web or the second continuous web 83 has a width selected to accommodate the width of the sole on a wide variety of shoe sizes and types plus providing sufficient material to form overlapping junctions or longitudinal seams with continuous webs 81 and 85. The overlapping junction or longitudinal seam between continuous web 81 and 83 is defined in part by a pair of longitudinal bonds 118. The overlapping junction or longitudinal seam formed between continuous web 83 and continuous web 85 is defined in part by a pair of longitudinal bonds 120. As best shown in FIG. 3, width 32 of the portion of middle panel 43 between longitudinal edges 119 and 121 corresponds approximately with the maximum width for the sole of a shoe that will fit within the resulting disposable shoe cover 20.

For some applications the width of continuous web or first web 81 and the width of continuous web or third web 85 are selected to be approximately equal to each other and to the width of middle web 83. For other applications, it may be desirable to have the width of first web 81 and third web 85 substantially larger than the width of middle continuous web 83. Increasing the width of first webs 81 and third 85 will result in a disposable shoe cover having a greater height to cover more of a wearer's leg above shoe 22. Also, additional continuous webs and elastomeric straps may be used to provide a disposable shoe cover having an increased height. For example, a disposable shoe cover (not expressly shown) which extends from the wearer's foot to just below the wearer's knee may be formed from five continuous webs and six elastomeric straps.

For some surgical procedures, medical personnel often wear protective coverings extending from the wearer's shoes to the knees. U.S. Pat. No. 4,093,124 entitled "Protective Shoe Covering" shows an example of such protective shoe and leg coverings. This patent is incorporated by reference for all purposes within this application.

For purposes of illustration, guide 108 is shown at the entrance to bonding apparatus 100 to fold first longitudinal edge 109 of continuous web 81 over elastomeric strap 87. Bonding apparatus 100 will then form longitudinal bond 112 between first longitudinal edge 109 and an adjacent portion of continuous web 81 to provide a long, continuous loop with elastomeric strap 87 disposed therein. In a similar manner, guide 110 is provided to fold first longitudinal edge 111 of continuous web 85 over elastomeric strap 93. Bonding apparatus 100 will then form longitudinal bond 114 between first longitudinal edge 111 and a portion of continuous web 85 to provide a long, continuous loop with elastomeric strap 93 disposed therein.

For the embodiment of the present invention shown in FIG. 2, second longitudinal edge 119 of continuous web 81 overlaps an adjacent portion of middle continuous web 83. In a similar manner, second longitudinal edge 121 of continuous web 85 overlaps an adjacent portion of middle continuous web 83. Elastomeric strap 89 is disposed between the overlapping portions of continuous web 81 and 83. Elastomeric strap 91 is disposed between the overlapping portions of continuous web 83 and 85. Bonding apparatus 100 forms a pair of longitudinal bonds 118 extending longitudinally parallel with each other along opposite sides of elastomeric strap 89. A pair of longitudinal bonds 120 are formed on opposite sides of elastomeric strap 91.

The overlapping configuration of continuous web 81, 83 and 85 allows the resulting disposable shoe cover 20 to be formed without any upwardly facing edges or seams that could possibly trap liquids or other types of contaminants. Longitudinal edges 119 and 121 will eventually be facing downward on the exterior of disposable shoe cover 20.

Longitudinal edges 123 and 125 of continuous web 83 will be disposed within the interior of disposable shoe cover 20. For one application bonds 112, 114, 118 and 120 are preferably long thermal bonds. Thermal bonds satisfactory for use with this invention may be formed by various techniques including but not limited to ultrasonic, radio frequency, heat and pressure, impulse sealing and laser bonding. However, other bonding techniques such as sewing and/or adhesives may be satisfactorily used to form intermediate piece 102.

Intermediate piece 102 is next formed into a series of blanks 40 from which disposable shoe cover 20 may be fabricated. The length of blank 40 and particularly the length of middle panel 43 is selected to correspond approximately with the length of the largest shoe that will fit within the resulting disposable shoe cover 20.

For purposes of illustration, blank 40 is shown in FIGS. 3 and 4 secured between tensioners 104 and 106. In actual practice, blank 40 will preferably remain a part of and be secured to intermediate piece 102 within a series of tensioners 104 and 106 as each blank 40 moves through different steps in the process of fabricating disposable shoe cover 20. Tensioners 104 and 106 are provided to maintain the desired tension on elastomeric straps 87, 89, 91 and 93 until various steps associated with fabrication of disposable shoe cover 20 from blank 40 have been completed and blank 40 can be cut or released from intermediate piece 102.

Blank 40 as shown in FIGS. 3–9 may be described as a generally quadrilateral sheet of material formed from three panels 41, 43, and 45. For purposes of explanation, panel 41 may sometimes be referred to as the first panel. Panel 43 may sometimes be referred to as the second panel or middle panel. Panel 45 may sometimes be referred to as the third panel. Panel 41 is formed from a portion of continuous web 81, panel 43 from continuous web 83 and panel 45 from continuous web 85.

Panels 41, 43 and. 45 have a generally rectangular configuration with respective longitudinal axii or center lines 42, 44 and 46. Longitudinal axis 44 of panel 43 corresponds with the longitudinal axis or center line of the associated blank 40. Longitudinal axii 42, 44 and 46 are arranged approximately parallel with each other and laterally offset from each other as a result of the previously described procedure for forming intermediate piece 102 from continuous webs 81, 83 and 85.

Blank 40 includes first edge 51 and second edge 52 which are disposed opposite from each other. First edge 51 and second edge 52 extend generally parallel with respect to respective axis 42 and 46. Blank 40 also includes third edge 53 and fourth edge 54 which are disposed opposite from each other and extend between first edge 51 and second edge 52. Third edge 53 and fourth edge 54 also extend laterally from longitudinal axis 44 of middle panel 43. For purposes of explanation, first edge 51 and second edge 52 may sometimes be referred to as longitudinal edges. Third edge 53 and fourth edge 54 may sometimes be referred to as lateral edges. For some applications, blank 40 may have a configuration other than quadrilateral as shown in FIGS. 3 and 4.

As best shown in FIG. 4, bonded areas 56 and 57 are preferably formed adjacent to respective opposite ends of first edge 51. Bond areas 58 and 59 formed adjacent to respective opposite ends of second edge 52. Bond areas 56 and 57 cooperate with each other to retain tension placed on the portion of elastomeric band 87 disposed adjacent to and extending along first edge 51. Bonded areas 58 and 59 cooperate with each other to retain tension placed on the portion of elastomeric band 93 disposed adjacent to and extending along second edge 52.

Bonded areas 60 and 61 are formed on the overlapping portions of first panel 41 and second panel 43 to retain tension placed on the portion of elastomeric band 89 disposed there between. Bonded areas 62 and 63 are formed on the overlapping portions of second panel 43 and third panel 45 to retain tension placed on the portion of elastomeric band 91 disposed there between.

Bonded areas 56 through 63 are preferably formed prior to cutting or releasing blank 40 from intermediate piece 102. Bonded areas 56 through 63 cooperate with each other to retain respective portions of elastomeric bands 87, 89, 91 and 93 attached to blank 40. Bonded areas 56 through 63 may either be formed within bonding apparatus 100 or may be formed on intermediate piece 102 at a later step (not expressly shown) during the fabrication of disposable shoe cover 20.

The tension retained in the portion of elastomeric band 87 extending between bonded areas 56 and 57 will result in substantial gathering or bunching of first edge 51 when blank 40 is released or cut from intermediate piece 102. In a similar manner bonded areas 60 and 61 cooperate with the portion of elastomeric band 89 extending therebetween, bonded areas 62 and 63 cooperate with the portion of elastomeric band 91 extending therebetween and bonded areas 58 and 59 cooperate with the portion of elastomeric band 93 extending therebetween to gather blank 40 when released from tensioners 104 and 106. Therefore, blank 40 is preferably held in tension during fabrication of disposable shoe cover 20.

For one application as shown in FIG. 4, bonded areas 60 and 62 are preferably formed approximately two and one-half inches from third edge or lateral edge 53. Bonded areas 61 and 63 are preferably formed approximately four inches from fourth edge or lateral edge 54. The distance between lateral edge 53 and bonded areas 60 and 62 is selected to accommodate the heel and quarter of a wide variety of shoe sizes and types. The distance between bonded areas 61 and 63 and lateral edge 54 is selected to accommodate the toe and vamp of a wide variety of shoe sizes and types.

Figure 7:
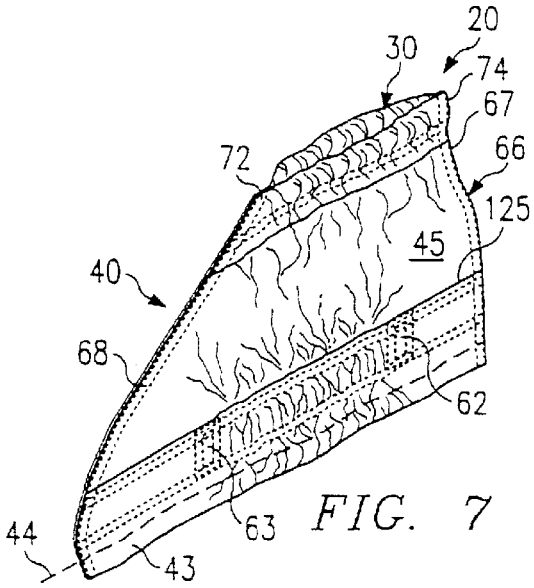
FIG. 7 is a schematic drawing showing an isometric view of showing still another step in the process of fabricating a disposable shoe cover from the blank of FIG. 4.

As best shown in FIGS. 5, 6 and 7, first panel 41 and third panel 45 are folded toward each other along longitudinal center line 44. For one application, a generally W-shaped fold 48 is preferably formed in middle panel 43 extending along longitudinal center line 44. Cooperation between W-shaped fold 48 and elastomeric bands 89 and 91 allows the resulting disposable shoe cover 20 to conform with the configuration of a wide variety of shoe sizes and types.

Folding blank 40 as shown in FIGS. 5, 6, and 7 results in placing panels 41 and 45 in close juxtaposition with each other. Folding blank 40 also places portions 53*a* and 53*b* of lateral edge 53 immediately adjacent to each other and portions 54*a* and 54*b* of lateral edge 54 immediately adjacent to each other. Opening 30 for placing disposable shoe cover 20 on the foot of wearer 22 is defined in part by placing first longitudinal edge 51 and second longitudinal edge 52 adjacent to each other and forming bonded seams 66 and 68.

As best shown in FIG. 6, bonded seam 66 is preferably formed between adjacent portions of lateral edges 54*a* and 54*b* extending from the adjacent ends of first edge 51 and second edge 52 at location 74 to W-shaped fold 48. Bonded seam 66 joins adjacent portions of first panel 41 and third panel 45 at what will eventually be the back or heel portion of disposable shoe cover 20. For some applications, bonded seam 66 may extend in a substantially straight line perpendicular to longitudinal center line 44, first edge 51, and second edge 52. For other applications, bonded seam 66 may include a slightly inward taper or slope 67 to provide a more comfortable fit with the leg and ankle of wearer 22.

As best shown in FIG. 6, bonded seam 68 is preferably formed between adjacent portions of first panel 41 and third panel 45 extending from the extreme end of W-shaped fold 48 to location 72 intermediate the ends of the first edge 51 and second edge 52. Bonded seam 68 has a generally curved configuration that will eventually be the front or toe portion of disposable shoe cover 20. The portion of bonded seam 68 immediately adjacent to the junction between first panel 41, middle panel 43 and third panel 45 includes toe portion 69 with a radius of curvature selected to accommodate the toe of a wide variety of shoe sizes and types. Bonded seam 68 includes tapered portion 70 extending from toe portion 69 to location 72 intermediate the ends of first edge 51 and second edge 52. Tapered portion 70 is sized to accommodate the vamp of a wide variety of shoe sizes and types.

For one application, bonded seams 66 and 68 are preferably formed while blank 40 is held in tension. After seams 66 and 68 have been formed, disposable shoe cover 20 may be released from the associated blank 40 by die cutting techniques while blank 40 is held in tension.

Opening 30 is further defined by the portions of first longitudinal edge 51 and second longitudinal edge 52 extending between location 72 and location 74 at which seam 66 intersects and bonds together adjacent portions of first longitudinal edge 51 and second longitudinal edge 52. A portion of elastomeric bands 87 and 93 will be trapped in tension between location 72 and location 74. The tension trapped in elastomeric bands 87 and 93 will assist in securing disposable shoe cover 20 on the foot of wearer 22.

After portions of first panel 45, middle panel 43 and third panel 45 have been bonded with each other as shown in FIG. 6, excess material may be cut away to provide the desired configuration for disposable shoe cover 20 as shown in FIG. 7. Disposable shoe cover 20 is then preferably turned inside out prior to use on a wearer's foot. By turning disposable shoe cover 20 inside out, portions of seams 66 which will be adjacent to the heel and the portions of seam 68 which will be adjacent to the toe are retained within the interior of disposable shoe cover 20 to provide a better fit in cooperation with W-shaped fold 48 and to minimize any particulate contamination from seams 66 and 68. Also, the portion of longitudinal edges 123 and 125 of continuous web 83 will be positioned within the interior of disposable shoe cover 20 leaving downwardly facing longitudinal edges 119 and 121 on the exterior of disposable shoe cover 20.

Figure 8:
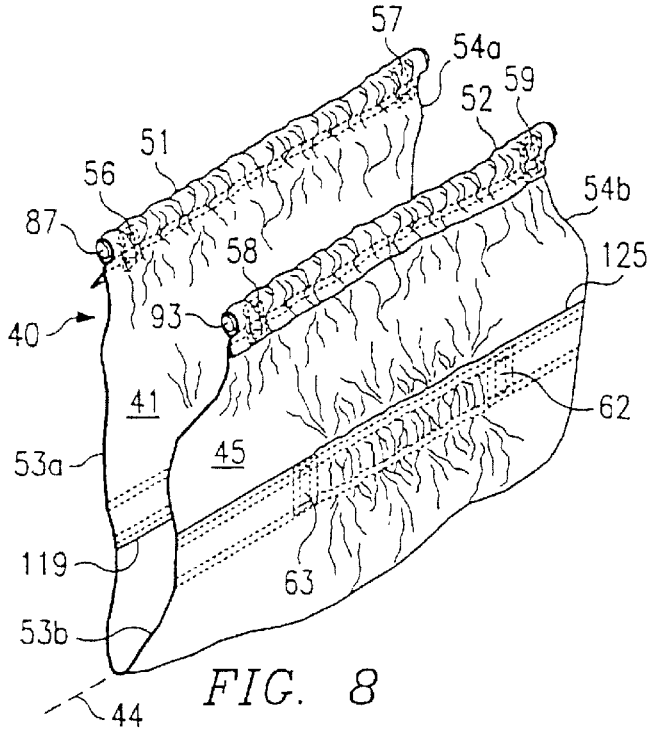
FIG. 8 is a schematic drawing showing an isometric view of the blank of FIG. 4 folded in accordance with an alternative embodiment of the present invention.
Figure 9:
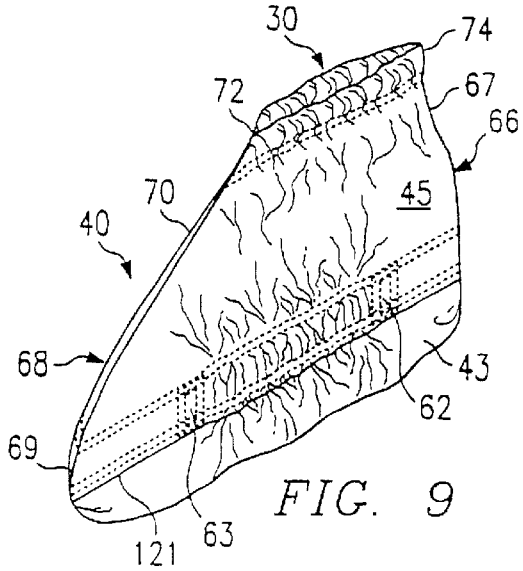
FIG. 9 is a schematic drawing showing another step in the process of fabricating a disposable shoe cover after folding a blank as shown in FIG. 8.

An alternative configuration for folding blank 40 to form disposable shoe cover 20 is shown in FIGS. 8 and 9. For this application, middle panel 43 is simply folded in half along longitudinal center line 44 to place first panel 41 and second panel 45 in close juxtaposition with each other. Bonded seams 66 and 68 are formed as previously described and any excess material removed. For some applications, removal of the excess material may not be required. Disposable shoe cover 20, as shown in FIG. 9, is preferably completed by inverting the bonded and cut portion of blank 40. It may be particularly beneficial to simply fold blank 40 in half as shown in FIG. 8 when middle panel 43 comprises material that is difficult to shape into a W-type fold.

Figure 10:
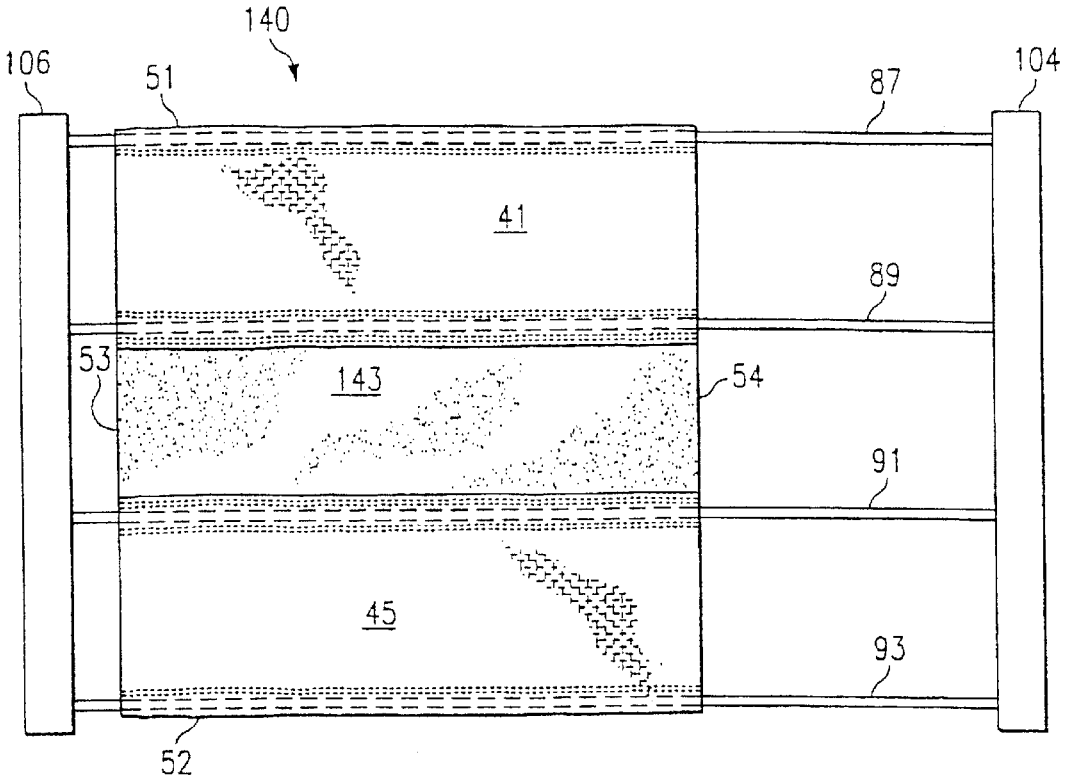
FIG. 10 is a schematic drawing showing a plan view of a blank formed with panels of different types of material.

FIG. 10 shows blank 140 which may be described as a generally quadrilateral sheet of material formed from three panels 41, 143, and 45 using techniques as previously described with respect to blank 40. Middle panel 143 is formed from material used to form first panel 41 and third panel 45.

For some applications, middle panel 143 may be formed from rubber such as shown in U.S. Pat. No. 3,308,562, entitled "Sanitary Shoe Cover of the Type Having a Conductive Sole" or slip resistant material such as shown in U.S. Pat. No. 4,598,485, entitled "Slip-Resistant Disposable Shoe Cover". Middle panel 143 may be formed from conductive material to protect against accumulation of static electricity such as shown in U.S. Pat. No. 3,898,750, entitled "Universal Size Disposable Shoe Cover or Vinyl Material With Anti-Static Agents" and U.S. Pat. No. 3,684,922, entitled "Anti-Static Plastic Shoe Cover and Method of Making Same". Each of the above-referenced patents is incorporated by reference for all purposes within this application.

For some applications, middle panel 143 may be formed from material which is stretchable in the longitudinal direction or the machine direction as the respective continuous webs move through the associate bonding apparatus 100. Panel 143 may also be stretchable in the lateral direction or cross-direction. Forming middle panel 143 from such stretchable material may allow reducing the total amount of material required to form a disposable shoe cover that can be used with the same range of shoe sizes and types. Various woven and non-woven materials are available that can be stretched in the machine direction and/or the cross-direction. If desired, panels 41, 143 and 45 may be formed from such stretchable material.

For other applications, middle panel 143 may be formed from a composite material having multiple layers. For example, the exterior surface of panel 143 may be formed by a layer of adhesive film to provide a sticky or tacky surface for walking and another layer may be formed from stretchable material as previously described. The present invention allows selecting material to form panel 143 with a tacky film surface on both the interior and the exterior. Thus, the resulting disposable shoe cover 20 may be fabricated with a suitable coefficient of friction provided by the exterior of panel 143 for safe walking and a suitable coefficient of friction between the interior of panel 143 and shoe 22 to prevent sliding of shoe 22 within disposable shoe cover 20. Composite materials having the previously discussed characteristics are available from various manufacturers including Tredegar Film Products, 1100 Boulders Parkway, Richmond, Va. 23225.

Figure 11:
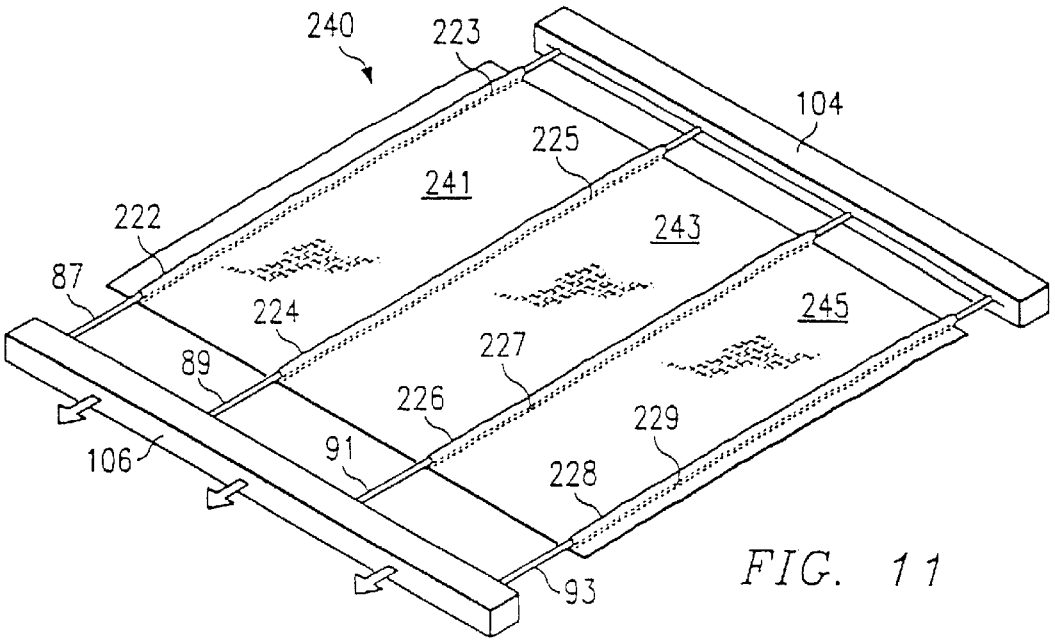
FIG. 11 is a schematic drawing showing an isometric view of a blank formed from a single web of material which has been divided into three panels along with an alternative configuration for attaching elastomeric bands to the blank.

Blank 240, as shown in FIG. 11, may be described as a generally quadrilateral sheet of material formed from a single, continuous web (not expressly shown). The width of this single continuous web will be approximately equal to the combined width of continuous webs 81, 83 and 85 as shown in FIG. 2. Portions of blank 240 are gathered together to form long, continuous loops or sleeves 222, 224, 226 and 228 by respective longitudinal bonds 223, 225, 227 and 229. Elastomeric straps 87, 89, 91 and 93 are preferably disposed within the respective sleeve 222, 224, 226 and 228. Sleeve 222, 224, 226, and 228 cooperate with each other to divide blank 240 into three panels 241, 243 and 245 similar to previously described panels 41, 43 and 45. Blank 240 may then be formed into disposable shoe cover 20 as previously described with respect to blank 40.

Figure 12:
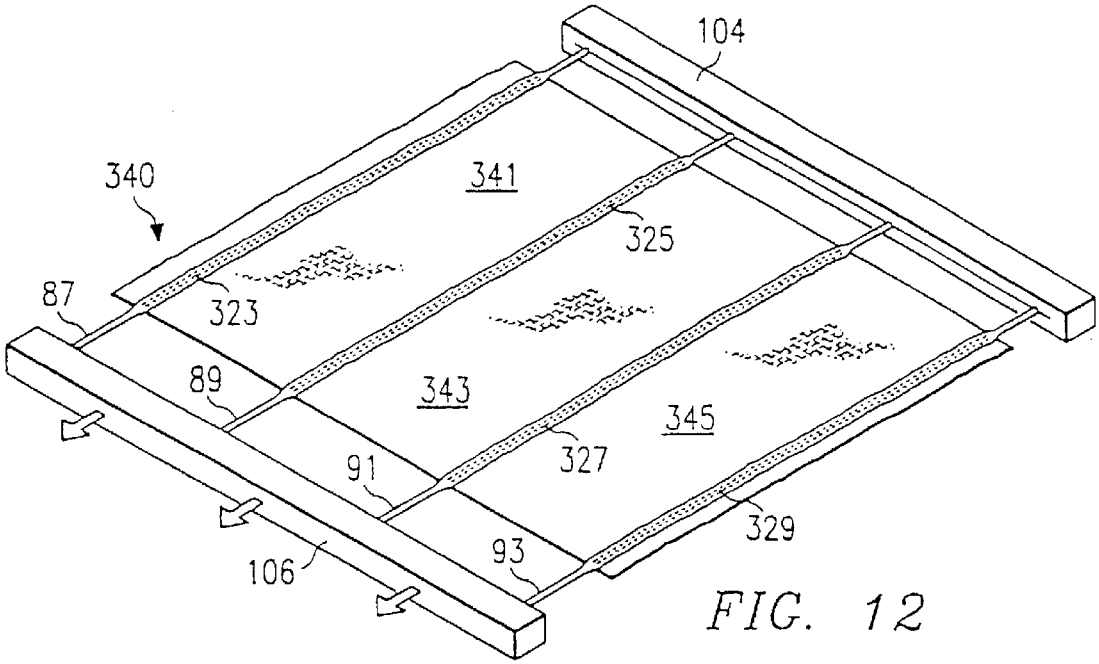
FIG. 12 is a schematic drawing showing an isometric view of a blank formed from a single web of material which has been divided into three panels along with still another configuration for attaching elastomeric bands to the blank.

Blank 340, as shown in FIG. 12, may be described as a generally quadrilateral sheet of material formed from a single, continuous web (not expressly shown). The width of this single continuous web will be approximately equal to the combined with of continuous webs 81, 83 and 85 as shown in FIG. 2. Portions of elastomeric straps 87, 89, 91, and 93 are directly bonded to blank 340 by respective longitudinal bonds 323, 325, 327 and 329. The bonded portions of elastomeric bands 87, 89, 91 and 93 cooperate with each other to divide blank 340 into three panels 341, 343, and 345 similar to previously described panels 41, 43 and 45. Blank 340 may then be formed into disposable shoe cover 20 as previously described with respect to blank 40.

Figure 13:
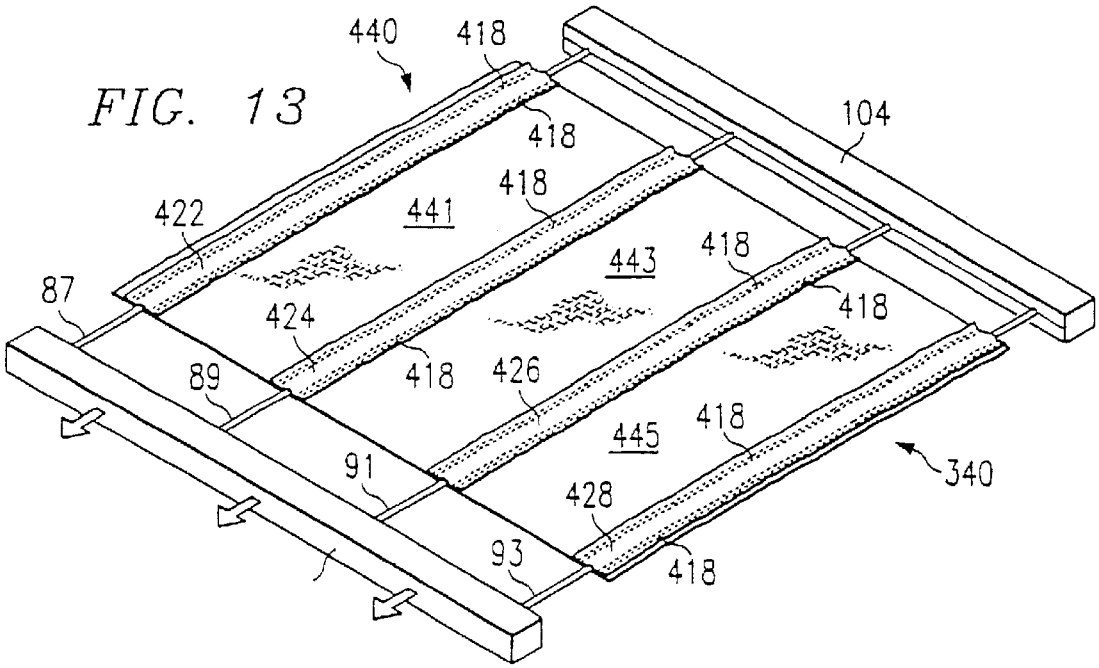
FIG. 13 is a schematic drawing showing an isometric view of a blank formed from a single web of material which has been divided into three panels along with a further alternative configuration for attaching elastomeric bands to the blank.

Blank 440, as shown in FIG. 13, may be described as a generally quadrilateral sheet of material formed from a single, continuous web (not expressly shown). The width of this single, continuous web will be approximately equal to the combined width of continuous webs 81, 83 and 85 as shown in FIG. 2. Four continuous strips of relatively narrow material (not expressly shown) may be used to form casings 422, 424, and 426 and 428 on panel 440. Each casing 422, 424, 426 and 428 is preferably secured to blank 440 by a respective pair of longitudinal bonds 418. Portions of elastomeric bands 87, 89, 91 and 93 are preferably disposed within respective casings 422, 424, 426 and 428. Appropriate bonded areas (not expressly shown) may be formed to trap the desired amount of tension in the respective elastomeric bands 87, 89, 91 and 93. Casings 422, 424, 426 and 428 cooperate with each other to divide blank 440 into three panels 441, 443 and 445 similar to previously described panels 41,43 and 45. Panel 440 may then be formed into disposable shoe cover 20 as previously described with respect to blank 40.

Figure 14:
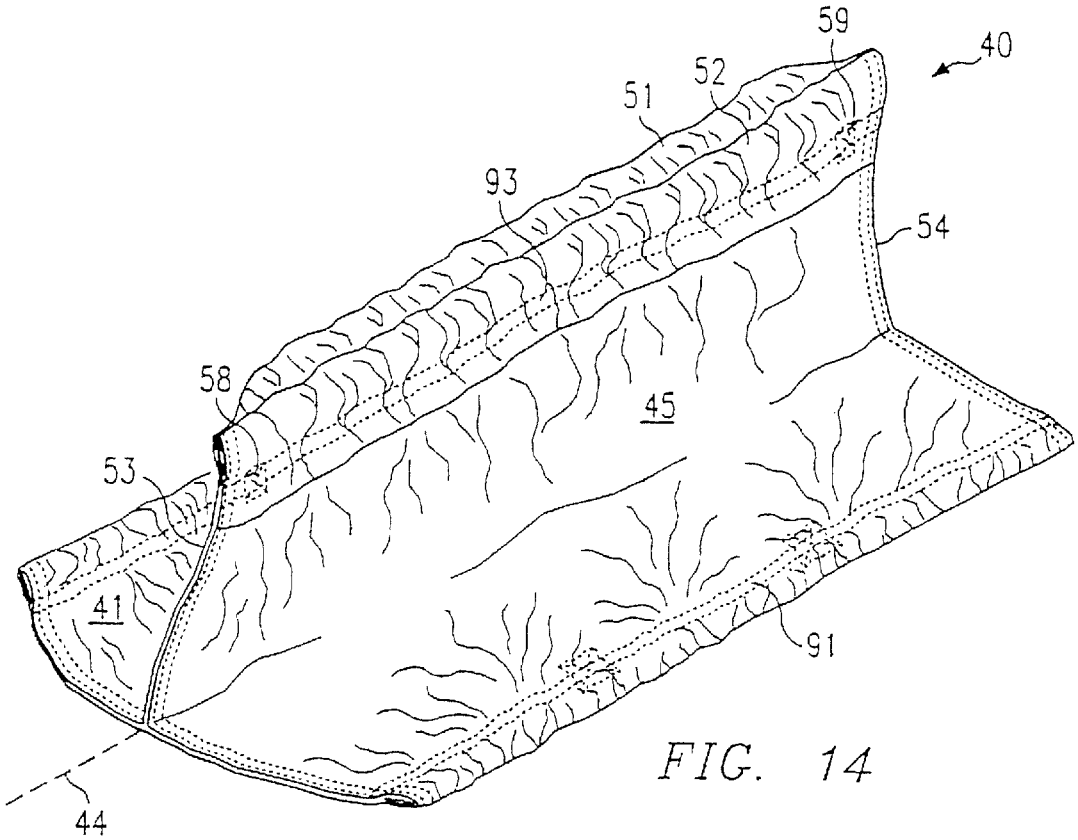
FIG. 14 is a schematic drawing showing an isometric view of another alternative way of folding a blank to form a disposable shoe cover in accordance with teachings of the present invention.

A further alternative configuration for folding blank 40 is shown in FIG. 14. For this application, middle panel 43 remains essentially flat or not folded and first panel 41 and second panel 45 are folded along their respective longitudinal center lines 42 and 46 with a portion extending essentially normal or perpendicular to middle panel 43. This type of fold results in lateral edges 53 and 54 having a generally T-shaped configuration. The adjacent portions of lateral edges 53 and 54 may be bonded with each other to retain the generally T-shaped configuration during the remaining fabrication steps associated with forming disposable shoe cover 20. Seams (not expressly shown) similar to previously described seams 66 and 68 may then be formed in adjacent portions of panels 41 and 45. Blank 40 may then be formed into disposable shoe cover 20 as previously described.

Continuous webs 81, 83 and 85 may be formed from a wide variety of materials such as textiles, nonwoven, woven, paper, plastic films and composites of these materials. Specific examples include canvas, polyethylene film backed nonwoven fabric, paper products such as "Tyvek" available from E.I. duPont Nemours and Company, polytectofluoralethylene, spunbounded polypropylene, meltblown polypropylene, and fiber glass composites.

For some applications, continuous webs 81, 83 and/or 85 may have two or more layers of material that have been laminated to each other. Fiber glass may be included as one layer to provide protection in potentially harsh chemical environments. Examples of fibrous nonwoven webs formed from two or more layers of material that may be satisfactorily used with the present invention are shown in U.S. Pat. No. 5,490,846, entitled "Surge Management Fibrous Nonwoven Web for Personal Care Absorbent Articles and the Like"; U.S. Pat. No. 5,362,306, entitled "Surgical Stockinette"; U.S. Pat. No. 5,409,761, entitled "Breathable Nonwoven Composite Barrier Fabric and Fabrication Process"; and U.S. Pat. No. 5,486,166, entitled "Fibrous Nonwoven Web Surge Layer for Personal Care Absorbent Articles and the Like". Each of these previously noted patents is incorporated for all purposes within this application.

An additional preferred embodiment of the disposable shoe cover 20 according to the present invention is illustrated generally in FIGS. 15–16 and 18–19. In this particular preferred embodiment, bonded back or heel seam 66 is also formed between adjacent portions of lateral edges 54*a* and 54*b* extending from the adjacent ends of first edge 51 and second edge 52 (referring to the blanks of FIGS. 4–5, 8, and 10). As discussed above, in relation to FIGS. 5 and 6, seam 66 may extend in a substantially straight or vertical line with respect to longitudinal center line 44 of middle panel 43, and may also include a slightly inward taper or sloped section,67 to provide a more comfortable fit with the leg and ankle of the wearer.

Figure 15:
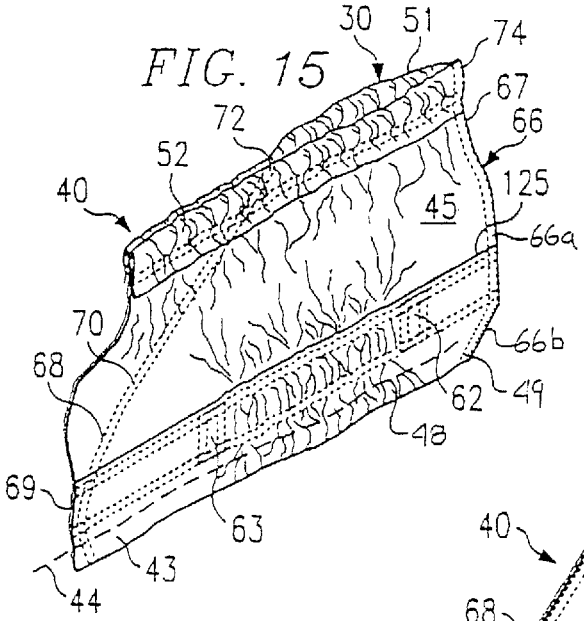
FIG. 15 is a schematic drawing showing an isometric view in the process of fabricating an alternative embodiment of a disposable shoe cover incorporating an angled heel seam section.
Figure 16:
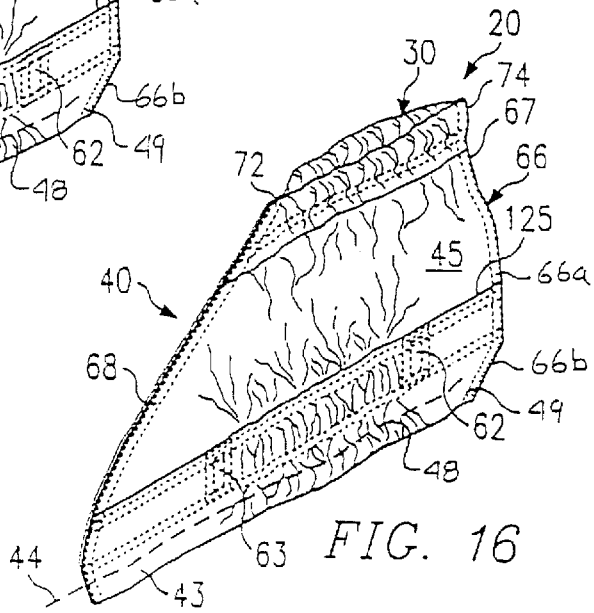
FIG. 16 is an additional schematic drawing showing an isometric view of an additional step in the process of fabricating the alternative shoe cover illustrated in FIG. 15.

This particular embodiment also includes an angled seam section 66*b* that angles to the longitudinal center line of middle panel 43 in a direction towards the toe section of shoe cover 20. Referring particularly to FIGS. 15 and 16, angled seam section 66*b* is angled directly to the fold point 49 in middle panel 43. In other words, referring to FIGS. 15 and 16, reference character 49 indicates the end of the longitudinal W-shaped fold 48 in the sole portion of middle panel 43. Thus, angled seam section 66*b* is formed from sealed adjacent edges 54*a* and 54*b* of middle panel 43.

In the embodiment illustrated, angled seam section 66*b* extends from vertical seam section 66*a*. However, it should be understood that the entire back or heel seam 66 could comprise a generally arcuate seam that angles or curves towards longitudinal center line 44 in generally the same manner as angled seam section 66*b*. A presently preferred ratio of rise to run for angled seam section 66*b* is about 1⅜ inches to 2 inches in an embodiment designed to fit shoes of varying width and size.

The shoe cover 20 incorporating angled seam section 66*b* is not limited to an embodiment of the present invention incorporating three separate panels, but is just as applicable to a disposable shoe cover formed from a single continuous web of material, for instance as described in relation to FIGS. 11 through 13 above.

Figure 17:
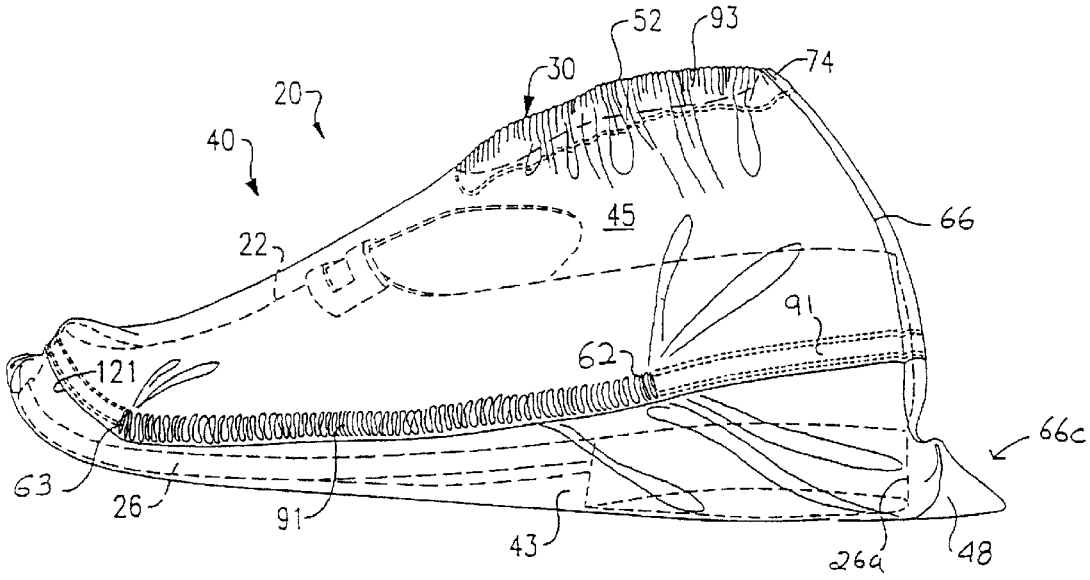
FIG. 17 is an additional perspective view of the shoe cover according to the invention illustrated in FIG. 1.

FIG. 17 illustrates the disposable shoe cover 20 according to the embodiment of FIG. 1. In this embodiment wherein seam 66 extends generally vertically or perpendicular to the longitudinal center line of middle panel 43, the bottom or sole portion of middle panel 43 will form a "bunch" 66*c* at location 49 defining the end of the fold, particularly the W-shaped fold 48. This bunched portion 66*c* is a result of the fact that middle panel 43 does not incorporate additional lateral seams or seals extending across the width of the sole portion. Such additional seams would add substantially to the manufacturing cost and complexity of shoe covers 20 according to the invention. Although the embodiment of the present invention illustrated in FIG. 17 is particularly useful in many applications, the bunched portion 66*c* of middle panel 43 may be undesirable in certain situations, particularly wherein bunched portion 66*c* may tend to fold under the sole of the shoe cover. In this situation, the bunched portion 66*c* may become bothersome to the wearer as might a pebble or stone under the sole of the shoe. If the bunched portion 66*c* extends rearward from the shoe, as illustrated in FIG. 17, it is possible that this bunched portion can become caught in equipment or under rollers of various devices or equipment.

Figure 18:
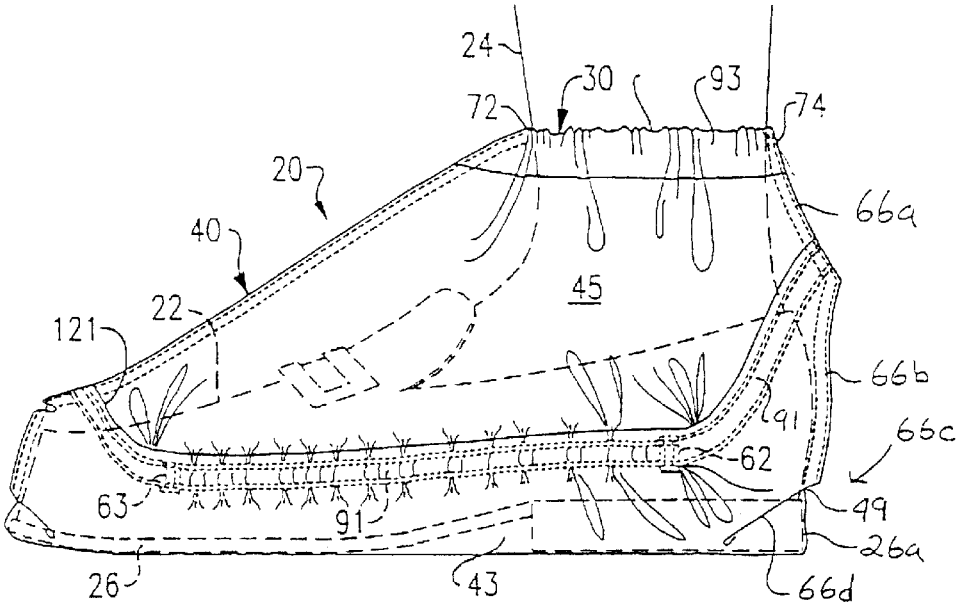
FIG. 18 is a perspective view of the shoe covers illustrated in FIGS. 15 and 16 disposed on the foot of a wearer.
Figure 19:
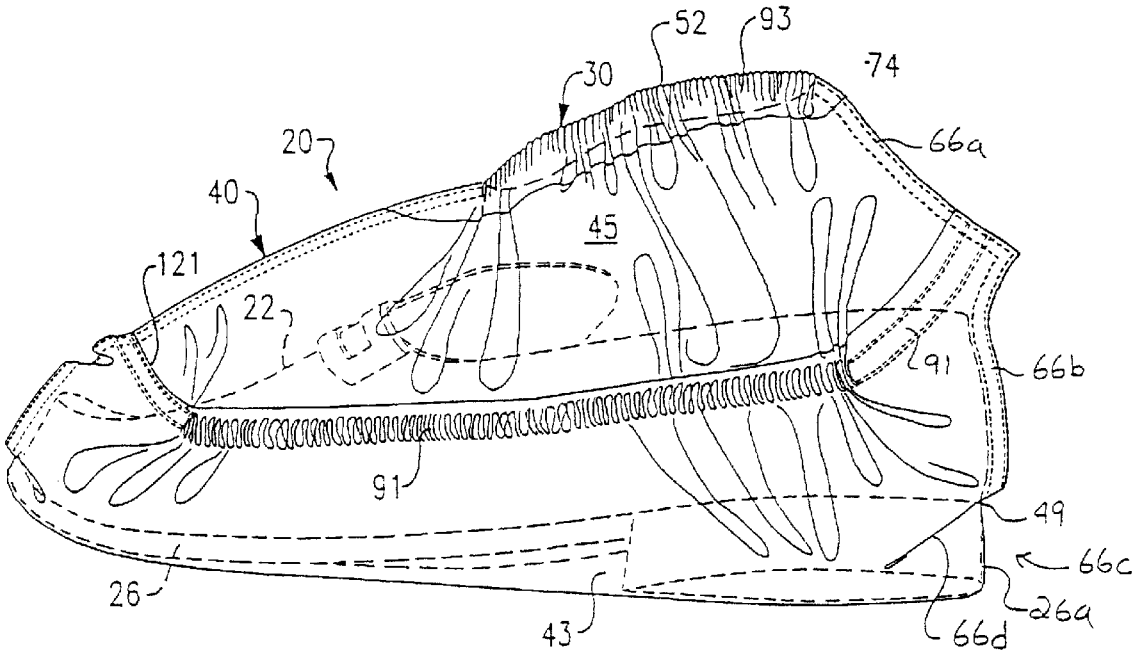
FIG. 19 is an additional perspective view of the shoe cover in FIG. 18.

Referring to FIGS. 18 and 19, it can be seen that the embodiment of shoe cover 20 according to FIGS. 15 and 16 ensures that bunched portion 66*c* of middle panel 43 is always disposed along the back portion of the shoe. When this particular embodiment is placed on the foot of a wearer, the back edge 26*a* of the heel will slide down angled seam section 66*b* when the shoe cover is pulled upward from location 74. Thus, angled seam section 66*b* is pulled upwards along the back portion of the shoe such that the end location 49 of the fold in middle panel 43 is also disposed along the back portion of the shoe. The entire shoe cover 20 is pulled essentially rearward and upward so that longitudinal seam 91 bends or angles towards the ankle of the wearer causing the bunched portion 66*c* to essentially wrap around the back edge of the heel from location 49 along fold lines 66*d*. This particular construction of shoe cover 20 thus forces the toe section of the shoe cover to conform more tightly against the toe of the shoe, at least to the extent that angled seam section 66*b* is offset or angled towards the toe section along the "run" thereof. In this regard, referring to FIGS. 15 and 16, the distance of middle panel 43 between the toe section and location 49 defines the maximum length of the shoe compatible with shoe cover 20.

Although the present invention and its advantages have been described in detail with respect to alternative embodiments, various changes and modifications may be suggested to one skilled in the art. It should be understood that various changes, substitutes, and alterations can be made therein without departing from the spirit and scope of the invention as defined in the following claims.

What is claimed is:

1. A method of fabricating a disposable shoe cover comprising the steps of:

attaching a plurality of elastomeric bands to a continuous web of material;

forming a blank having three panels defined by the elastomeric bands and having a generally rectangular configuration from the continuous web of material;

said panels defining two side panels, and a middle panel having two opposite edges, each said edge forming a longitudinal seam line between said middle panel and one said side panel;

wherein one said elastomeric band is disposed along at least a portion of each said longitudinal seam line, and said middle panel defines an integral seamless sole portion of said shoe cover;

folding the blank to partially define an opening to allow placing the disposable shoe cover over a shoe on a wearer's foot, bonding adjacent portions of the folded blank to further define the opening for the disposable shoe cover and to define a heel portion and a toe portion for the shoe cover; and releasing the disposable shoe cover from the continuous web of material.

2. The method as in claim 1, further comprising forming the continuous web from three rolls of material, and forming the blank with three panels, each panel being formed from one of the three rolls.

3. The method as in claim 1, further comprising forming the continuous web from a single continuous roll of material, and attaching the elastomeric bands to the single continuous roll of material so as to define the three panels in the blank.

4. The method as in claim 1, further comprising folding a middle panel of the blank with a generally W-shaped configuration.

* * * * *